US006605123B1

(12) United States Patent
Kasson et al.

(10) Patent No.: US 6,605,123 B1
(45) Date of Patent: Aug. 12, 2003

(54) SILICONE FINISHING COMPOSITIONS AND PROCESSES

(75) Inventors: Amy-Elizabeth Kasson, Ballston Spa, NY (US); Edward T. Simoneau, Greenwich, NY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/548,811

(22) Filed: Apr. 14, 2000

Related U.S. Application Data

(60) Provisional application No. 60/129,625, filed on Apr. 16, 1999.

(51) Int. Cl.[7] ..... D06Q 1/02; D06M 0/00; D06M 13/00

(52) U.S. Cl. ..... 8/142; 8/115.5; 8/116.1; 8/137; 252/8.63

(58) Field of Search ..... 8/142, 137, 115.5, 8/116.1; 252/8.63

(56) References Cited

U.S. PATENT DOCUMENTS

| | | | | |
|---|---|---|---|---|
| 2,176,705 A | | 10/1939 | Derby | 8/139.1 |
| 2,697,075 A | | 12/1954 | Echols | 252/170 |
| 2,941,952 A | | 6/1960 | Lewis et al. | 252/161 |
| 3,123,494 A | | 3/1964 | Charreau | 117/62 |
| 3,630,660 A | | 12/1971 | Welder | 8/139 |
| 4,005,231 A | | 1/1977 | Smith | 427/387 |
| 4,065,258 A | | 12/1977 | France | 8/142 |
| 4,115,061 A | | 9/1978 | Grünewälder | 8/137 |
| 4,136,045 A | | 1/1979 | Gault et al. | 252/135 |
| 4,501,682 A | | 2/1985 | Goodman et al. | 252/174.15 |
| 4,685,930 A | | 8/1987 | Kasprzak | 8/139.1 |
| 4,708,807 A | | 11/1987 | Kemerer | 252/8.06 |
| 4,911,853 A | | 3/1990 | Coffindaffer et al. | 252/8.8 |
| 4,961,753 A | | 10/1990 | Donkers et al. | 8/115.68 |
| 5,219,371 A | | 6/1993 | Shim et al. | 8/149 |
| 5,258,480 A | | 11/1993 | Eckberg et al. | 528/15 |
| 5,301,379 A | | 4/1994 | Schaal | 8/158 |
| 5,302,313 A | | 4/1994 | Asano et al. | 252/171 |
| 5,309,587 A | | 5/1994 | Fierro | 8/158 |
| 5,357,771 A | | 10/1994 | Schaal | 68/18 |
| 5,562,761 A | | 10/1996 | Dirschl et al. | 252/8.62 |
| 5,676,705 A | | 10/1997 | Jureller et al. | 8/142 |
| 5,702,535 A | | 12/1997 | Gray et al. | 134/10 |
| 5,865,852 A | | 2/1999 | Berndt | 8/142 |
| 6,001,343 A | * | 12/1999 | Trinh et al. | 424/76.4 |
| 6,046,152 A | * | 4/2000 | Vinson et al. | 510/428 |

FOREIGN PATENT DOCUMENTS

| | | |
|---|---|---|
| DE | 37 39 711 A1 | 6/1989 |
| JP | 06327888 | 11/1994 |
| JP | 09299687 | 11/1997 |
| WO | W/O 9401510 | 1/1994 |

* cited by examiner

*Primary Examiner*—Yogendra N. Gupta
*Assistant Examiner*—Derrick G. Hamlin

(57) ABSTRACT

A composition for finishing an article comprising a non-volatile siloxane, and a method for finishing an article with a composition comprising a non-volatile siloxane.

11 Claims, No Drawings

SILICONE FINISHING COMPOSITIONS AND PROCESSES

This application claims rights of priority from U.S. Provisional Patent Application Ser. No. 60/129,625, filed Apr. 16, 1999.

TECHNICAL FIELD

The present invention is directed to a composition, more specifically, to a siloxane fluid based composition, for use in dry cleaning, to a dry cleaning process using the composition, and to a finishing process using a siloxane fluid based composition.

BACKGROUND

Silicone finishes are commonly used for fabric finishing at the textile mill stage. Dry cleaning of garments has been known to strip finishes from the garments during the process. If the dry cleaning process utilizes a silicone solvent, a silicone finish could be introduced into the process to treat the garment and restore a luxurious feel to the garment. Finishes which provide softness, antistatic properties, water repellence, hand and drape would be useful and desirable.

Processes and compositions for cleaning, treating and waterproofing are known in the art, see for example, U.S. Pat. Nos. 3,123,494; 4,065,258; 4,708,807; 4,911,853; and 5,562,761. Many of these processes and compositions use conventional volatile organic solvents. What is needed in the art is a composition and process for restoring the finish to garments which utilizes a siloxane fluid based composition.

SUMMARY OF THE INVENTION

The present invention is directed to a composition for finishing an article, comprising a non-volatile siloxane.

In a preferred embodiment, the finishing composition comprises a non-volatile siloxane and a volatile siloxane.

In a first preferred embodiment, the finishing composition comprises a non-volatile siloxane and a volatile linear or branched siloxane.

In a second preferred embodiment, the finishing composition comprises a non-volatile siloxane and a volatile cyclic siloxane.

In a third preferred embodiment, the finishing composition comprises a non-volatile siloxane and a mixture of a volatile linear or branched siloxane and a cyclic siloxane.

In a fourth preferred embodiment, the finishing composition comprises a non-volatile siloxane and a mixture of a non-volatile siloxane and an organic solvent.

In a second aspect, the present invention is directed to a method for refinishing an article, comprising contacting the article with a composition comprising a non-volatile siloxane.

In a third aspect, the present invention is directed to a method for cleaning an article, comprising contacting the article with a cleaning composition comprising a volatile siloxane and further contacting the article with a finishing composition comprising a non-volatile siloxane.

In a first preferred embodiment, the cleaning composition of the method of the present invention comprises a volatile linear or branched siloxane.

In a second preferred embodiment, the cleaning composition comprises a cyclic siloxane.

In a third preferred embodiment, the cleaning composition comprises a volatile branched or linear siloxane and a cyclic siloxane.

In a fourth preferred embodiment, the cleaning composition comprises further comprises a volatile organic solvent.

In a fourth aspect, the present invention is directed to an article cleaned and finished by the methods of the present invention.

The method of the present invention is effective in refinishing the article after cleaning, and improving the feel, appearance, water repellency, or some combination thereof of the article. When combined with a cleaning composition or cleaning step, the process of the present invention is also effective in removing both non-polar stains, such as for example, oil and sebum, and polar stains, such as, for example, salts, components of coffee, tea and grape juice, from the article, for example, a garment, being cleaned and in suppressing redeposition of soil on the article.

DETAILED DESCRIPTION OF THE INVENTION

As used herein, the term "non-volatile" means that the siloxane would remain on the article or fabric after the completion of the dry cleaning. Generally, the boiling point of non-volatile siloxanes is higher than the temperature at which the dry cleaning apparatus operates.

In a preferred embodiment, the finishing component of the present invention comprises one or more non-volatile siloxane compounds selected from the group consisting of dialkylpolysiloxane fluids, aminofunctional siloxane fluids, curable aminofunctional siloxane fluids, silanol-terminated dialkylpolysiloxane fluids, curable silanol-terminated siloxane fluids, epoxyfunctional siloxane fluids, titanate silicone fluids and mixtures thereof.

As used herein, an "aminofunctional siloxane" is a copolymer that contains amine functional and polysiloxane units. The amino level is from about 0.1 to about 0.8 milli equivalents per gram. The aminofunctional siloxanes may be linear or branched.

As used herein, a "curable aminofunctional siloxane" is a curable polymer branched chain that contains amine functional and polysiloxane units, where the ends are stopped with hydroxy or methoxy units to further polymerize. The amino level is from about 0.1 to about 0.8 milli equivalents per gram.

As used herein, a "silanol-terminated dialkylpolysiloxane" is a dialkylpolysiloxane with hydroxide ends of the formula

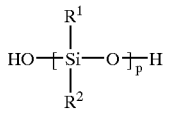

where p is chosen such that the viscosity is at the desired level and each $R^1$ and $R^2$ is independently alkyl, preferably $(C_1–C_6)$alkyl, more preferably methyl.

As used herein, a "curable silanol-terminated siloxane" is a curable siloxane with hydroxide ends.

As used herein, an "epoxyfunctional siloxane" is a siloxane where the epoxy functionality is obtained when certain of the hydrogen atoms on the polysiloxane chain of the hydrogen-siloxane copolymer are reacted with organic molecules that contain both an ethylenic unsaturation and epoxide functionality. This reaction can take place by, for example, a hydrosilation addition reaction as taught in U.S. Pat. No. 5,258,480, the disclosure of which is hereby incorporated herein.

As used herein, a "titanate silicone" comprises a titanate cure system containing an MQ resin, a silanol fluid and a titanate crosslinker such as tetraisobutoxy titanate, where exposure to moisture cures the silicone to a water repellent system.

The silicone finish remaining on the article would be at a level of from about 0.1 to about 2.0 weight percent based on the dry weight of the articles to be finished. The finishing can be applied in the same machine as the cleaning or in a separate machine. The article may be cleaned using any cleaning method, including contacting with linear or branched siloxanes, cyclic siloxanes, hydrocarbon or chlorinated solvents, or mixtures thereof.

As used herein, "organic cleaning solvent" means an organic solvent that does not contain silicon. Examples of organic cleaning solvents are perchloroethylene, and 100% hydrocarbon solvents such as DF2000 (commercially available from Exxon) and stoddard solvent.

Preferably, the first preferred embodiment of the finishing composition comprises, based on 100 parts by weight ("pbw") of the composition, from 0.01 to about 20 pbw, more preferably from 0.1 to about 10 pbw, even more preferably from 0.1 to about 5 pbw of the non-volatile siloxane and from about 80 to 99.99 pbw, more preferably from about 90 to about 99.9 pbw, even more preferably from about 95 to about 99.9 pbw of a volatile siloxane liquid. The volatile siloxane liquid may be a volatile linear, branched or cyclic siloxane or combination thereof. In a preferred embodiment, the volatile siloxane liquid comprises a volatile linear, branched or cyclic siloxane.

Preferably, the second preferred embodiment of the finishing composition of the present invention comprises, based on 100 parts by weight ("pbw") of the composition, from 0.01 to about 20 pbw, more preferably from 0.1 to about 10 pbw, even more preferably from 0.1 to about 5 pbw of the non-volatile siloxane, from 80 pbw to 99.99 pbw, more preferably from 90 pbw to 99.9 pbw and even more preferably from 95 pbw to 99.9 pbw of the linear or branched volatile siloxane. In a preferred embodiment, the finishing composition additionally comprises less than 10 pbw, more preferably from 0.01 to less than 10 pbw, and even more preferably from 0.5 to 8 pbw of a surfactant. In a more preferred embodiment, the finishing composition further comprises, based on 100 pbw of the composition, up to 10 pbw, more preferably from 0.01 to 10 pbw, even more preferably from 0.1 to 5 pbw, most preferably 0.5 to 2 pbw water.

Preferably, the third preferred embodiment of the finishing composition of the present invention comprises, based on 100 parts by weight ("pbw") of the composition, from 0.01 to about 20 pbw, more preferably from 0.1 to about 10 pbw, even more preferably from 0.1 to about 5 pbw of the non-volatile siloxane, from 80 pbw to 99.99 pbw, more preferably from 90 pbw to 99.9 pbw and even more preferably from 95 pbw to 99.9 pbw of the cyclic siloxane. In a preferred embodiment, the finishing composition additionally comprises less than 10 pbw, more preferably from 0.1 to less than 10 pbw, and even more preferably from 0.5 to 8 pbw of a surfactant. In a more preferred embodiment, the finishing composition further comprises, based on 100 pbw of the composition, up to 10 pbw, more preferably from 0.01 to 10 pbw, even more preferably from 0.1 to 5 pbw, most preferably 0.5 to 2 pbw water.

Preferably, the fourth preferred embodiment of the finishing composition of the present invention comprises, based on 100 pbw of the composition, from 0.01 to 20 pbw, more preferably from 0.1 to 10 pbw, even more preferably from 0.1 to 5 pbw of the non-volatile siloxane, from about 80 to 99.9 pbw, more preferably from about 90 to about 99.9 pbw of the linear or branched volatile siloxane, and from 0.1 to 49.5 pbw, more preferably from pbw 1 to 45.45 pbw and even more preferably from 1 to 20 pbw of the cyclic siloxane. In a preferred embodiment, the finishing composition further comprises, based on 100 pbw of the composition, up to 10 pbw, more preferably from 0.01 pbw to 10 pbw, even more preferably from 0.1 pbw to 5 pbw, most preferably 0.5 pbw to 2 pbw water.

Preferably, the fifth preferred embodiment of the finishing composition of the present invention comprises, based on 100 parts by weight ("pbw") of the composition, from 0.01 to about 20 pbw, more preferably from 0.1 to about 10 pbw, even more preferably from 0.1 to about 5 pbw of the non-volatile siloxane, from 80 pbw to 99.99 pbw, more preferably from 90 pbw to 99.9 pbw and even more preferably from 95 pbw to 99.9 pbw of the mixture of the volatile siloxane and the organic solvent. In a preferred embodiment, the finishing composition additionally comprises less than 10 pbw, more preferably from 0.1 to less than 10 pbw, and even more preferably from 0.5 to 8 pbw of a surfactant. In a more preferred embodiment, the finishing composition further comprises, based on 100 pbw of the composition, up to 10 pbw, more preferably from 0.01 to 10 pbw, even more preferably from 0.1 to 5 pbw, most preferably 0.5 to 2 pbw water.

Compounds suitable as the linear or branched, volatile siloxane component of the present invention are those containing a polysiloxane structure that includes from 2 to 20 silicon atoms. Preferably, the linear or branched volatile siloxanes are relatively volatile materials, having, for example, a boiling point of below about 300° C. at a pressure of 760 millimeters of mercury ("mm Hg").

In a preferred embodiment, the linear or branched volatile siloxane comprises one or more compounds of the structural formula (I):

$$M_{2+y+2z}D_xT_yQ_z \quad (I)$$

wherein:

M is $R^9{}_3SiO_{1/2}$;

D is $R^{10}{}_2SiO_{2/2}$;

T is $R^{11}SiO_{3/2}$;

and Q is $SiO_{4/2}$ each $R^9$, $R^{10}$ and $R^{11}$ is independently a monovalent hydrocarbon radical; and x and y are each integers, wherein $0 \leqq x \leqq 10$ and $0 \leqq y \leqq 10$ and $0 \leqq z \leqq 10$.

Suitable monovalent hydrocarbon groups include acyclic hydrocarbon radicals, monovalent alicyclic hydrocarbon radicals, monovalent and aromatic hydrocarbon radicals. Preferred monovalent hydrocarbon radicals are monovalent alkyl radicals, monovalent aryl radicals and monovalent aralkyl radicals. In a preferred embodiment, the monovalent hydrocarbon radical is a monovalent $(C_1-C_6)$alkyl radical, most preferably, methyl.

As used herein, the term "$(C_1-C_6)$alkyl" means a linear or branched alkyl group containing from 1 to 6 carbons per group, such as, for example, methyl, ethyl, propyl, isopropyl, n-butyl, iso-butyl, sec-butyl, tert-butyl, pentyl, hexyl, preferably methyl.

As used herein, the term "aryl" means a monovalent unsaturated hydrocarbon ring system containing one or more aromatic rings per group, which may optionally be substituted on the one or more aromatic rings, preferably with one or more $(C_1-C_6)$alkyl groups and which, in the case of two or more rings, may be fused rings, including, for example, phenyl, 2,4,6-trimethylphenyl, 2-isopropylmethylphenyl, 1-pentalenyl, naphthyl, anthryl, preferably phenyl.

As used herein, the term "aralkyl" means an aryl derivative of an alkyl group, preferably a ($C_2$–$C_6$)alkyl group, wherein the alkyl portion of the aryl derivative may, optionally, be interrupted by an oxygen atom, such as, for example, phenylethyl, phenylpropyl, 2-(1-naphthyl)ethyl, preferably phenylpropyl, phenyoxypropyl, biphenyloxypropyl.

In a preferred embodiment, the linear or branched volatile siloxane comprises one or more of hexamethyldisiloxane, octamethyltrisiloxane, decamethyltetrasiloxane, dodecamethylpentasiloxane, tetradecamethylhexasiloxane, hexadecamethylheptasiloxane or methyltris (trimethylsiloxy)silane. In a more highly preferred embodiment, the linear or branched volatile siloxane of the present invention comprises octamethyltrisiloxane, decamethyltetrasiloxane, dodecamethylpentasiloxane or methyltris(trimethylsiloxy)silane. In a highly preferred embodiment, the siloxane component of the composition of the present invention consists essentially of decamethyltetrasiloxane.

Suitable linear or branched volatile siloxanes are made by known methods, such as, for example, hydrolysis and condensation of one or more of tetrachlorosilane, methyltrichlorosilane, dimethyldichlorosilane, trimethylchlorosilane, or by isolation of the desired fraction of an equilibrate mixture of hexamethyldisiloxane and octamethylcyclotetrasiloxane or the like and are commercially available.

Compounds suitable as the cyclic siloxane component of the present invention are those containing a polysiloxane ring structure that includes from 2 to 20 silicon atoms in the ring. Preferably, the linear, volatile siloxanes and cyclic siloxanes are relatively volatile materials, having, for example, a boiling point of below about 300° C. at a pressure of 760 millimeters of mercury ("mm Hg").

In a preferred embodiment, the cyclic siloxane component comprises one or more compounds of the structural formula (II):

(II)

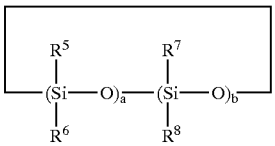

wherein:

each $R^5$, $R^6$, $R^7$ and $R^8$ is independently a monovalent hydrocarbon group, preferably a monovalent ($C_1$–$C_6$) alkyl radical, most preferably, methyl; and a and b are each integers wherein $0 \leqq a \leqq 10$ and $0 \leqq b \leqq 10$, provided that $3 \leqq (a+b) \leqq 10$.

In a preferred embodiment, the cyclic siloxane comprises one or more of octamethylcyclotetrasiloxane, decamethylcyclopentasiloxane, dodecamethylcyclohexasiloxane or tetradecamethylcycloheptasiloxane. In a more highly preferred embodiment, the cyclic siloxane of the present invention comprises octamethylcyclotetrasiloxane or decamethylcyclopentasiloxane. In a highly preferred embodiment, the cyclic siloxane component of the composition of the present invention consists essentially of decamethylcyclopentasiloxane.

Suitable cyclic siloxanes are made by known methods, such as, for example, hydrolysis and condensation of dimethyldichlorosilane and are commercially available.

It is believed that those cleaning compositions according to the present invention that lack a cyclic siloxane component would be more stable than those which include a cyclic siloxane component, in that cyclic siloxanes are known to ring open and polymerize under acidic and basic conditions.

The surfactant component of the cleaning compositions of the present invention may comprise one or more surfactants, including anionic, nonionic, Zwitterionic and amphoteric surfactants, that contains a moiety, such as for example, a polyalkylsiloxane moiety, that is soluble in the volatile siloxane component of the cleaning composition of the present invention and a moiety capable of compatiblizing any of a range of targeted staining components. Suitable surfactants include, for example, alkylbenzene sulfonates, ethoxylated alkyl phenols, ethoxylated fatty alcohols, alkylester alkoxylates, alkyl sulfonates, quaternary ammonium complexes, block propyleneoxide, ethyleneoxide copolymers, sorbitan fatty esters, sorbitan ethoxylates, Tergitols, tridecylalcohol ethoxylates, alkanolamides, sodium lauryl sulfonate, sodium stearate, sodium laureth sulfate, ammonium lauryl ether sulfonate, and silicone surfactants, such as for example, quaternary alkyl ammonium siloxanes, carboxyalkyl siloxanes, and polyether siloxane surfactants. In a preferred embodiment, the surfactant exhibits an hydrophilic-lipophilic balance ("HLB") of from 3 to 14, more preferably 5 to 11, as for example polyether siloxanes. Surfactants are generically known in the art and are available from a number of commercial sources.

In a preferred embodiment, the surfactant component of the present invention comprises one or more polyether siloxane compounds according to the structural formula III:

$$M_e D_f D^*_g M^*_{2-e} \quad \text{(III)}$$

wherein:

M is $R^{12}{}_3SiO_{1/2}$;

D is $R^{13}{}_2SiO_{2/2}$;

M* is $R^{14}{}_3SiO_{1/2}$;

D* is $R^{15}{}_2SiO_{2/2}$;

each $R^{12}$ and $R^{13}$ is independently H or a monovalent hydrocarbon group;

each $R^{14}$ is independently H, a monovalent hydrocarbon group, or $—(CH_2)_h—O—(C_2H_4O)_i—(C_3H_6O)_j—(C_nH_{2n}O)_k—R^{16}$, provided that at least one $R^{11}$ is $—(CH_2)_h—O—(C_2H_4O)_i—(C_3H_6O)_j—(C_nH_{2n}O)_k—R^{16}$;

each $R^{15}$ is independently H, a monovalent hydrocarbon group, or $—(CH_2)_h—O—(C_2H_4O)_i—(C_3H_6O)_j—(C_nH_{2n}O)_k—R^{16}$, provided that at least one $R^{15}$ is $—(CH_2)_h—O—(C_2H_4O)_i—(C_3H_6O)_j—(C_nH_{2n}O)_k—R^{16}$;

$R^{16}$ is H, a monovalent hydrocarbon group or alkyloxy;

$0 \leqq e \leqq 2$;

$0 \leqq f \leqq 1000$;

$0 \leqq g \leqq 50$, provided that $g \geqq 1$ if e is 2;

$1 \leqq h \leqq 16$;

$0 \leqq i \leqq 30$;

$0 \leqq j \leqq 30$;

$0 \leqq k \leqq 30$; and $4 \leqq f \leqq 8$, provided that $i+j+k>0$.

In a preferred embodiment, $2 \leqq i \leqq 25$, $0 \leqq j \leqq 25$ and $0<k<25$, more preferably k is 0.

The composition of the present invention may optionally contain other components, such as, for example, fabric conditioners, brighteners, bleaching agents, enzymes, water-repellent treatments, anti-static agents, fragrances and detergents.

An article, such as for example, a textile or leather article, typically, a garment, is dry cleaned and refinished by contacting the article with the composition of the present invention. In a preferred embodiment, the articles to be refinished include textiles made from natural fibers, such as for example, cotton, wool, linen and hemp, and blends thereof, from synthetic fibers, such as, for example, polyester fibers, polyamide fibers, polypropylene fibers and elastomeric fibers, and blends thereof , from blends of natural and synthetic fibers, from natural or synthetic leather or natural or synthetic fur.

In a first preferred embodiment of the method of the present invention, the article to be refinished is immersed in a refinishing composition. The article and the finishing composition are then separated, by, for example, one or more of draining and centrifugation. In a preferred embodiment, separation of the article and finishing composition i s follow ed by the application of heat, preferably, heating to a temperature of from 15° C. to 120° C., preferably from 20° C. to 100° C., or reduced pressure, preferably, a pressure of from 1 mm Hg to 750 mm Hg, or by application of heat and reduced pressure, to the article.

In a second preferred embodiment of the method of the present invention, the article to be cleaned and refinished is immersed in a cleaning composition. The article and cleaning composition are then separated, by, for example, one or more of draining and centrifugation. The article is then immersed in a finishing composition, drained and the finishing composition is extracted. In a preferred embodiment, separation of the article and finishing composition is followed by the application of heat, preferably, heating to a temperature of from 15° C. to 120° C., preferably from 20° C. to 100° C., or reduced pressure, preferably, a pressure of from 1 mm Hg to 750 mm Hg, or by application of heat and reduced pressure, to the article.

In a third preferred embodiment of the method of the present invention, the article to be cleaned and refinished is immersed in a composition containing the cleaning composition and the finishing composition.

The cleaning method of the present invention removes particulate soils, such as for example, insoluble particles such as silicates, carbon black, as well as both polar stains, such as for example, salts, sugars, water soluble biological fluids, and nonpolar stains, such as, for example, hydrocarbons, oils, greases, sebum, from the garment and prevents the redeposition of the soils, polar stains and nonpolar stains on the article. The finishing method of the present invention will restore a luxurious feel to the garment. Additionally, the finishing method of the present invention will improve water repellency, hand or feel, and overall appearance.

The following examples illustrate the process of the present invention. They are illustrative and the claims are not to be construed as limited to the examples.

EXAMPLES

Non-volatile silicones were evaluated for use as finishing compositions in silicone solvents used in dry-cleaning equipment. Twelve different fabrics were treated with ten different finishing solutions, as well as with a solvent alone. The fabrics tested were: Denim; Cotton Linen Brown; Cotton Linen Yellow; Cotton Broad Cloth; Wool Blend; 100% Wool; Wool Polyester Blend; Taffeta; Rayon; Silk; Satin; and Rayon.

The ten different finishing solutions consisted of the following silicones blended with decamethylcyclopentasiloxane ($D_5$) solvent to obtain the proper concentration for putting approximately a 1% dry finish on the fabrics.

The silicone materials used in the finishing solutions:

$D_5$ Decamethylcyclopentasiloxane
1 Dimethylpolysiloxane fluid (350 centistokes)
2 Dimethylpolysiloxane fluid (1000 centistokes)
3 Dimethylpolysiloxane fluid (10,000 centistokes)
4 Aminofunctional methylpolysiloxane fluid (0.15 meq/mg)
5 Aminofunctional methylpolysiloxane fluid (0.50 meq/mg)
6 Curable silicone polymer system—titanate cure
7 Curable aminofunctional methylpolysiloxane fluid
8 Silicone polyether silicone fluid
9 Silicone polyether silicone fluid
10 Silicone polyether silicone fluid It was necessary to determine the wet pick-up of each fabric when treated under the same conditions. The percent wet pick up was determined by the following equation:

$$\%\ \text{Wet Pick-Up} = \frac{\text{Wet Weight} - \text{Dry Weight}}{\text{Dry Weight}} \times 100\%$$

To determine the proper concentration for putting about a 1% dry finish on the fabric, the following formula was used:

$$\%\ \text{Solution Concentration} = \frac{\text{Desired Dry Pick-Up}}{\%\ \text{Wet Pick-Up}} \times 100\%$$

A - Denim

| Materials | Initial Weight | Wet Weight | Dry Weight | % Wet Pick up | % Solution Used |
|---|---|---|---|---|---|
| $D_5$ | 46.08 | 77.56 | 45.63 | 69.9 | — |
| 1 | 23.79 | 40.71 | 22.45 | 81.34 | 1.23 |
| 2 | 24.99 | 43.04 | 23.58 | 82.5 | 1.21 |
| 3 | 9.57 | 15.76 | 9.02 | 74.7 | 1.33 |
| 4 | 8.97 | 15.07 | 8.5 | 77.3 | 1.29 |
| 5 | 11.24 | 20.18 | 10.83 | 86.3 | 1.16 |
| 6 | 11.54 | 20.47 | 11.04 | 85.4 | 1.17 |
| 7 | 14.06 | 25.93 | 13.37 | 93.9 | 1.06 |
| 8 | 12.48 | 21.93 | 12.47 | 75.9 | 1.31 |
| 9 | 11.89 | 21.19 | 11.9 | 78.1 | 1.28 |
| 10 | 14.34 | 21.19 | 14.35 | 47.7 | 2.09 |

B - Cotton Linen Brown

| Materials | Initial Weight | Wet Weight | Dry Weight | % Wet Pick up | % Solution Used |
|---|---|---|---|---|---|
| $D_5$ | 27.17 | 45.25 | 26.77 | 69.03 | — |
| 1 | 13.03 | 22.14 | 12.47 | 77.6 | 1.28 |
| 2 | 13.32 | 23.25 | 12.74 | 82.4 | 1.21 |
| 3 | 8.31 | 13.58 | 7.91 | 71.68 | 1.4 |
| 4 | 8.42 | 13.81 | 8.04 | 71.8 | 1.39 |
| 5 | 8.39 | 14.68 | 8.21 | 78.8 | 1.27 |
| 6 | 8.37 | 14.54 | 8.12 | 79.1 | 1.26 |
| 7 | 8.05 | 13.94 | 7.74 | 80.1 | 1.25 |
| 8 | 8 | 14.36 | 8 | 79.5 | 1.26 |
| 9 | 8.06 | 13.71 | 8.04 | 70.5 | 1.42 |
| 10 | 7.91 | 14.13 | 8.02 | 76.2 | 1.31 |

C - Cotton Linen Yellow

| Materials | Initial Weight | Wet Weight | Dry Weight | % Wet Pick up | % Solution Used |
|---|---|---|---|---|---|
| $D_5$ | 23.34 | 39.1 | 23.02 | 69.85 | — |
| 1 | 11.82 | 20.01 | 11.32 | 76.8 | 1.3 |
| 2 | 11.21 | 18.92 | 10.74 | 76.2 | 1.31 |
| 3 | 8.38 | 13.73 | 8 | 71.6 | 1.4 |
| 4 | 9.61 | 16.08 | 9.2 | 74.8 | 1.34 |
| 5 | 10.77 | 19.28 | 10.53 | 83.1 | 1.2 |
| 6 | 7.95 | 13.88 | 7.7 | 80.26 | 1.24 |
| 7 | 12.25 | 21.88 | 11.75 | 86.2 | 1.16 |
| 8 | 14.46 | 26.17 | 14.92 | 75.4 | 1.33 |
| 9 | 12.72 | 22.45 | 12.91 | 73.9 | 1.35 |
| 10 | 11.42 | 20.57 | 11.65 | 76.6 | 1.31 |

D - Cotton Broad Cloth

| Materials | Initial Weight | Wet Weight | Dry Weight | % Wet Pick up | % Solution Used |
|---|---|---|---|---|---|
| $D_5$ | 16.45 | 22.16 | 16.27 | 36.2 | — |
| 1 | 5.91 | 12 | 5.72 | 109.8 | 0.91 |
| 2 | 5.51 | 11.6 | 5.33 | 117.6 | 0.85 |
| 3 | 2.31 | 4.82 | 2.27 | 112.3 | 0.89 |
| 4 | 2.42 | 5.2 | 2.36 | 120.3 | 0.83 |
| 5 | 2.38 | 5.26 | 2.3 | 128.7 | 0.78 |
| 6 | 2.67 | 6.01 | 2.6 | 131.2 | 0.76 |
| 7 | 2.45 | 5.35 | 2.4 | 122.9 | 0.81 |
| 8 | 2.37 | 6.02 | 2.3 | 186 | 0.54 |
| 9 | 2.4 | 5.36 | 2.38 | 125.2 | 0.8 |
| 10 | 2.36 | 5.56 | 2.35 | 136.5 | 0.73 |

E - Wool Blend

| Materials | Initial Weight | Wet Weight | Dry Weight | % Wet Pick up | % Solution Used |
|---|---|---|---|---|---|
| $D_5$ | 9.28 | 38.42 | 18.97 | 102.5 | — |
| 1 | 9.46 | 17.91 | 9.29 | 92.8 | 1.08 |
| 2 | 9.78 | 18.72 | 9.59 | 95.2 | 1.05 |
| 3 | 9.54 | 19.91 | 9.56 | 108.3 | 0.92 |
| 4 | 9.61 | 19.07 | 9.45 | 101.8 | 0.98 |
| 5 | 9.24 | 19.24 | 9.14 | 110.5 | 0.9 |
| 6 | 9.31 | 20.16 | 9.12 | 121.4 | 0.82 |
| 7 | 8.95 | 19.2 | 8.72 | 120.2 | 0.83 |
| 8 | 9.44 | 21.74 | 9.25 | 135 | 0.74 |
| 9 | 9.09 | 19.89 | 8.84 | 125 | 0.8 |
| 10 | 9.18 | 20.24 | 8.98 | 125.4 | 0.8 |

F - 100% Wool

| Materials | Initial Weight | Wet Weight | Dry Weight | % Wet Pick up | % Solution Used |
|---|---|---|---|---|---|
| $D_5$ | 20.13 | 41.44 | 20.02 | 106.9 | — |
| 1 | 10.61 | 21.77 | 10.59 | 105.6 | 0.95 |
| 2 | 9.56 | 19.16 | 9.59 | 99.8 | 1 |
| 3 | 5.91 | 13.03 | 5.86 | 122.4 | 0.82 |
| 4 | 4.78 | 9.88 | 4.67 | 111.6 | 0.89 |
| 5 | 5.8 | 13.06 | 5.71 | 128.7 | 0.78 |
| 6 | 6.01 | 14.6 | 5.9 | 147.45 | 0.68 |
| 7 | 5.92 | 13.33 | 5.84 | 128.3 | 0.78 |

-continued

F - 100% Wool

| Materials | Initial Weight | Wet Weight | Dry Weight | % Wet Pick up | % Solution Used |
|---|---|---|---|---|---|
| 8 | 5.92 | 14.44 | 5.86 | 146.4 | 0.68 |
| 9 | 5.74 | 12.66 | 5.65 | 124.1 | 0.81 |
| 10 | 6.08 | 14.5 | 5.97 | 142.9 | 0.7 |

G - Wool Polyester

| Materials | Initial Weight | Wet Weight | Dry Weight | % Wet Pick up | % Solution Used |
|---|---|---|---|---|---|
| $D_5$ | 24.22 | 49.1 | 23.92 | 105.3 | — |
| 1 | 11.98 | 23.71 | 11.59 | 104.6 | 0.96 |
| 2 | 11.4 | 22.63 | 11 | 105.7 | 0.94 |
| 3 | 10.25 | 21.88 | 10.07 | 117.3 | 0.85 |
| 4 | 10.51 | 20.94 | 10.17 | 105.9 | 0.94 |
| 5 | 10.69 | 24.5 | 10.39 | 135.8 | 0.74 |
| 6 | 10.28 | 22.43 | 9.96 | 125.2 | 0.8 |
| 7 | 10.66 | 22.86 | 10.26 | 122.8 | 0.81 |
| 8 | 10.38 | 23.68 | 9.97 | 137.5 | 0.73 |
| 9 | 10.32 | 22.84 | 9.94 | 129.8 | 0.77 |
| 10 | 10.59 | 23.59 | 10.18 | 131.7 | 0.76 |

H - Taffeta

| Materials | Initial Weight | Wet Weight | Dry Weight | % Wet Pick up | % Solution Used |
|---|---|---|---|---|---|
| $D_5$ | 9.02 | 12.08 | 8.98 | 34.5 | — |
| 1 | 4.38 | 5.83 | 4.43 | 31.6 | 3.16 |
| 2 | 4.42 | 6 | 4.36 | 37.6 | 2.66 |
| 3 | 2.72 | 3.7 | 2.69 | 37.5 | 2.66 |
| 4 | 2.78 | 3.8 | 2.74 | 38.7 | 2.58 |
| 5 | 4.37 | 6.73 | 4.38 | 53.7 | 1.86 |
| 6 | 4.48 | 6.71 | 4.43 | 51.46 | 1.94 |
| 7 | 2.95 | 4.31 | 2.91 | 48.1 | 2.07 |
| 8 | 2.85 | 4.46 | 2.82 | 58.2 | 1.7 |
| 9 | 2.7 | 3.88 | 2.65 | 46.4 | 2.15 |
| 10 | 2.72 | 3.98 | 2.68 | 48.5 | 2.06 |

I - Rayon

| Materials | Initial Weight | Wet Weight | Dry Weight | % Wet Pick up | % Solution Used |
|---|---|---|---|---|---|
| $D_5$ | 8.92 | 11.99 | 8.88 | 35.02 | — |
| 1 | 3.95 | 5.18 | 3.92 | 32.14 | 3.11 |
| 2 | 4.4 | 5.82 | 4.36 | 33.48 | 2.99 |
| 3 | 2.62 | 3.46 | 2.58 | 34.1 | 2.93 |
| 4 | 2.9 | 3.81 | 2.78 | 37.05 | 2.7 |
| 5 | 2.61 | 3.54 | 2.56 | 38.3 | 2.61 |
| 6 | 2.56 | 3.69 | 2.53 | 45.85 | 2.18 |
| 7 | 3.02 | 4.22 | 2.87 | 47.04 | 2.13 |
| 8 | 2.61 | 3.92 | 2.58 | 51.9 | 1.93 |
| 9 | 2.52 | 3.32 | 2.48 | 33.87 | 2.95 |
| 10 | 2.52 | 3.35 | 2.48 | 35.1 | 2.9 |

J-Silk

| Materials | Initial Weight | Wet Weight | Dry Weight | % Wet Pick up | % Solution Used |
|---|---|---|---|---|---|
| $D_5$ | 4.07 | 6.44 | 4.05 | 59 | — |
| 1 | 2.18 | 3.63 | 2.16 | 68.01 | 1.47 |
| 2 | 2.02 | 3.49 | 2.01 | 73.6 | 1.36 |
| 3 | 1.67 | 2.65 | 1.62 | 63.6 | 1.57 |
| 4 | 1.63 | 2.6 | 1.58 | 64.6 | 1.55 |
| 5 | 1.93 | 3.45 | 1.95 | 76.9 | 1.3 |
| 6 | 1.64 | 3.1 | 1.66 | 86.8 | 1.15 |
| 7 | 2.13 | 3.65 | 2.1 | 75.2 | 1.3 |
| 8 | 2.08 | 4.33 | 2.74 | 58 | 1.7 |
| 9 | 1.84 | 3.71 | 1.82 | 103.8 | 0.96 |
| 10 | 1.76 | 3.77 | 1.74 | 116.7 | 0.86 |

K-Satin

| Materials | Initial Weight | Wet Weight | Dry Weight | % Wet Pick up | % Solution Used |
|---|---|---|---|---|---|
| $D_5$ | 10.59 | 26.07 | 10.55 | 147.1 | — |
| 1 | 7.41 | 12.19 | 7.44 | 63.8 | 1.56 |
| 2 | 7.84 | 12.69 | 7.83 | 62.1 | 1.61 |
| 3 | 4.49 | 7.2 | 4.42 | 62.9 | 1.59 |
| 4 | 3.96 | 5.99 | 3.91 | 53.2 | 1.88 |
| 5 | 4.42 | 7.32 | 4.5 | 62.6 | 1.6 |
| 6 | 3.97 | 6.52 | 4.02 | 62.19 | 1.61 |

-continued

K-Satin

| Materials | Initial Weight | Wet Weight | Dry Weight | % Wet Pick up | % Solution Used |
|---|---|---|---|---|---|
| 7 | 4.68 | 8.01 | 4.65 | 72.3 | 1.38 |
| 8 | 4.61 | 7.63 | 4.58 | 66.59 | 1.5 |
| 9 | 4.28 | 7.68 | 4.25 | 80.71 | 1.23 |
| 10 | 4.26 | 7.51 | 4.24 | 77.12 | 1.29 |

L - Rayon

| Materials | Initial Weight | Wet Weight | Dry Weight | % Wet Pick up | % Solution Used |
|---|---|---|---|---|---|
| $D_5$ | 8.54 | 11.05 | 8.49 | 30.15 | — |
| 1 | 4.33 | 5.83 | 4.31 | 35.3 | 2.8 |
| 2 | 4.14 | 5.57 | 4.11 | 35.5 | 2.8 |
| 3 | 2.43 | 3.28 | 2.37 | 38.4 | 2.6 |
| 4 | 1.99 | 2.61 | 1.9 | 37.3 | 2.68 |
| 5 | 2.26 | 2.97 | 2.25 | 32 | 3.12 |
| 6 | 2.06 | 2.68 | 2.03 | 32.02 | 3.12 |
| 7 | 2.02 | 2.65 | 1.99 | 33.17 | 3.02 |
| 8 | 2.02 | 2.63 | 1.99 | 32.2 | 3.1 |
| 9 | 2.58 | 3.27 | 2.55 | 28.23 | 3.54 |
| 10 | 2.71 | 3.47 | 2.67 | 29.96 | 3.33 |

The following Tables show the test results for appearance, hand or feel, difference in hand and water repellency tests.

TABLE 1

Appearance

| Mat. | A | B | C | D | E | F | G | H | I | J | K | L |
|---|---|---|---|---|---|---|---|---|---|---|---|---|
| $D_5$ | 1 | 1 | 2-D | 1 | 1 | 1 | 2 | 1 | 1 | 2 | 1 | 1 |
| 1 | 1 | 1 | 1 | 1 | 1 | 1 | 1-DK | 1 | 1 | 2 | 1 | 1 |
| 2 | 2 | 1 | 1 | 1 | 1 | 1 | 1-DK | 1 | 1 | 2 | 1 | 1 |
| 3 | 3 | 1 | 1 | 1 | 1 | 1 | 1-DK | 1 | 1-DK | 2 | 2 | 1 |
| 4 | 3 | 1 | 2-D | 1 | 1 | 1 | 1-DK | 1 | 1-DK | 2 | 1 | 1 |
| 5 | 1 | 2 | 1 | 1 | 1 | 1 | 1-DK | 1 | 1-DK | 1 | 1 | 1 |
| 6 | 4 | 2 | 2-D | 1 | 1 | 3 | 1-DK | 1 | 1 | 5** | 1 | 1 |
| 7 | 2 | 1 | 1-B | 1 | 1 | 1 | 1-DK | 1 | 1-DK | 2 | 1-DK | 1 |
| 8 | 1 | 1 | 1 | 1-DK | 1 | 1 | 1-DK | 5* | 1-B | 4*** | 1-DK | 1 |
| 9 | 1 | 1 | 1 | 1 | 1 | 1 | 1-DK | 1 | 1 | 4**** | 1-DK | 1 |
| 10 | 1 | 1 | 1 | 1 | 1 | 1 | 1-DK | 1 | 1 | 2 | 1-DK | 1 |

Scale used to rate the appearance:
1 = no fading
2 = slight fading
3 = moderate fading
4 = tremendous fading
5 = color change
#-D = appearance rating (i.e., 1 for no fading) and dull cast to fabric
#-B = appearance rating and brighter
#-DK = appearance rating and darker
*= color bled into the white, or removed the white color
**= turned pink to purple
***= uneven fading, material migrated off of fabric
****= material migrated off of fabric

TABLE 2

| | Hand (or Feel) | | | | | | | | | | | |
|---|---|---|---|---|---|---|---|---|---|---|---|---|
| Mat. | A | B | C | D | E | F | G | H | I | J | K | L |
| $D_5$ | S | ND | ND | ND | ND | S | ND | ND | ND | ND | ND | S |
| 1 | S | ND | S | ND | ND | S | ND | S | ND | ND | ND | S |
| 2 | S | ND | S | ND | ND | S | S | S | ND | ND | ND | S |
| 3 | ND | S | S | S | ND | S | S | ND | ND | ND | ND | S |
| 4 | ND | S | S | S | S | ND | S | SS | ND | ND | ND | S |
| 5 | S | S | S | S | ND | S | S | ND | ND | ND | ND | S |
| 6 | S | ND | S | ND | ND | ND | S | S | ND | ND | ND | S |
| 7 | H | ND | S | ND | ND | S | ND | ND | F | ND | ND | S |
| 8 | S | SS | SLIP | F | ND | S | ND | S | ND | ND | ND | S |
| 9 | S | SS | SLIP | F | ND | ND | ND | S | ND | ND | ND | S |
| 10 | S | SS | SLIP | F | ND | S | ND | S | ND | ND | ND | S |

Hand (or feel) rating scale:
S = softer than standard
SS = superior softness
H = harder than standard
ND = no difference
SLIP = slipperier than standard
F = film on fabric
(The standard is uncoated, neat fabric)

TABLE 3

| | Water Repellency** | | | | | | | | | | | |
|---|---|---|---|---|---|---|---|---|---|---|---|---|
| Mat. | A | B | C | D | E | F | G | H | I | J | K | L |
| $D_5$ | 3 | 4 | 4 | 1 | 4 | 4 | 3 | 3 | 1 | 3 | 4 | 3 |
| 1 | 3 | 4 | 4 | 1 | 4 | 4 | 4 | 3 | 1 | 3 | 4 | 3 |
| 2 | 3 | 4 | 4 | 1 | 4 | 4 | 4 | 3 | 1 | 4 | 4 | 3 |
| 3 | 3 | 4 | 4 | 3 | 4 | 4 | 4 | 2 | 1 | 4 | 4 | 3 |
| 4 | 4 | 4 | 4 | 4 | 4 | 5 | 4 | 3 | 5 | 5 | 4 | 4 |
| 5 | 4 | 4 | 4 | 4 | 4 | 5 | 4 | 3 | 5 | 5 | 4 | 4 |
| 6 | 5 | 4 | 4 | 5 | 4 | 4 | 5 | 3 | 5 | 5 | 4 | 5 |
| 7 | 5 | 4 | 4 | 4 | 2 | 4 | 4 | 3 | 1 | 5 | 2 | 4 |
| 8 | 1 | 1 | 1 | 1 | 1 | 1 | 1 | 1 | 1 | 1 | 1 | 1 |
| 9 | 1 | 1 | 1 | 1 | 1 | 1 | 1 | 1 | 1 | 1 | 1 | 1 |
| 10 | 1 | 1 | 1 | 1 | 1 | 1 | 1 | 1 | 1 | 1 | 1 | 1 |
| C* | 3 | 4 | 4 | 3 | 4 | 3 | 3 | 3 | 1 | 1 | 1 | 1 |

C* is untreated fabric (control sample)
**Water Repellency was determined using DuPont Water Drop Test No. 3

The two silicone materials blended with cyclopentasiloxane ($D_5$) which performed the best are the aminofunctional methylpolysiloxane fluids. These two materials perform the best (lower number) in the fading test, the softness test and the water repellency test. The curable silicone polymer system, which is designed for water repellency, performed the best in the water repellency test.

The silicone polyether fluids and the curable silicone polymer system migrated off the fabric, had uneven fading patterns on the swatches, and did not feel much softer than the standards used. The swatches of fabrics on which these materials were used also had slight to definite color changes. For example, the pink colored polka dots on the satin material, turned purple. All three polyethers performed poorly in the water repellency testing. The curable silicone polymer system also tended to make the fabric swatches bleed into the silicone solvent blend. The fabrics that bled were Denim, Cotton Linen Brown, Cotton Linen Yellow, 100% Wool, and Silk.

The dimethylpolysiloxane fluids performed well on average, but were not the best performers, for all of the tests. The 1000 centistokes dimethylpolysiloxane performed the best of these three dimethylpolysiloxane fluids, with the 350 centistokes dimethylpolysiloxane next.

What is claimed is:

1. A method for dry cleaning and finishing an article, comprising a) contacting the article with a dry cleaning composition comprising a volatile siloxane; and b) contacting the article with a finishing composition comprising a non-volatile siloxane.

2. The method of claim 1, wherein the volatile siloxane comprises a cyclic siloxane.

3. The method of claim 1, wherein the volatile siloxane comprises a linear or branched siloxane.

4. The method of claim 1, wherein the volatile siloxane comprises a mixture of a linear or branched siloxane and a cyclic siloxane.

5. The method of claim 1, wherein the cleaning composition further comprises an organic solvent.

6. The method of claim 1, wherein the finishing composition comprises a non-volatile siloxane selected from the group consisting of dialkylpolysiloxane fluids, aminofunctional siloxane fluids, curable aminofunctional siloxane fluids, silanol-terminated dialkylpolysiloxane fluids, curable silanol-terminated siloxane fluids, titanate curable silicone polymer systems, methylalkyl siloxane fluids, dialkyl polyether copolymer fluids, epoxyfunctional siloxane fluids and mixtures thereof.

7. The method of claim 1, wherein the finishing composition further comprises a surfactant.

8. The method of claim 1, wherein the finishing composition further comprises water.

9. An article cleaned by the method of the claim 1.

10. The article of claim 1, wherein a portion of the siloxane finishing composition remains on the article after finishing.

11. The article of claim 1, wherein the feel, appearance, water repellency, or some combination thereof is improved.

* * * * *